US006360494B1

(12) United States Patent
Emerson

(10) Patent No.: US 6,360,494 B1
(45) Date of Patent: Mar. 26, 2002

(54) INCARCERATION FACILITY

(76) Inventor: Carl Sonny Emerson, 1608 W. Indiana Ave., Midland, TX (US) 79701

( * ) Notice: Subject to any disclaimer, the term of this patent is extended or adjusted under 35 U.S.C. 154(b) by 0 days.

(21) Appl. No.: 09/476,586

(22) Filed: Dec. 31, 1999

(51) Int. Cl.[7] ..... E04H 3/08
(52) U.S. Cl. ..... 52/106
(58) Field of Search ..... 52/106

(56) References Cited

U.S. PATENT DOCUMENTS

| | | | | | |
|---|---|---|---|---|---|
| 158,966 | A | * | 1/1875 | Mullett | 52/106 |
| 244,358 | A | * | 7/1881 | Brown | 52/106 |
| 353,662 | A | * | 12/1886 | Brown | 52/106 |
| 516,450 | A | * | 3/1894 | Salfield | 52/106 |
| 722,781 | A | | 3/1903 | Weary | |
| 729,913 | A | | 6/1903 | Angell | |
| 2,156,859 | A | * | 5/1939 | Lowe | 52/106 |
| 2,700,798 | A | | 2/1955 | Perrottet | |
| 4,640,214 | A | | 2/1987 | Bruns | |
| 4,970,834 | A | * | 11/1990 | Polson | 52/106 |
| 5,210,985 | A | * | 5/1993 | Hsu | 52/169.6 |
| 5,351,450 | A | | 10/1994 | Moskowitz | |
| 5,353,557 | A | * | 10/1994 | Lerner et al. | 52/106 |
| 5,832,151 | A | | 11/1998 | Riser et al. | |

OTHER PUBLICATIONS

Cain, Work session: Proposed Law Enforcement Center Oct. 2, 2000, Carpenter, p. 1–6.*

Cain, Work session: Proposed Law Enforcement Center Oct. 17, 2000, Carpenter, p. 1–5.*

Young, McHenry's jail to have latest design Feb. 1, 1989, Young, 1–2.*

Krauth, Direct Supervison Jails Nov. 1986, National Institute of Corrections, p. 1.*

Gillmore et al, Staff turner and Correctional Management in New Generation Jails Jan. 1990, pp. 1–2.*

* cited by examiner

*Primary Examiner*—Carl D. Friedman
*Assistant Examiner*—Phi Dieu Tran A
(74) *Attorney, Agent, or Firm*—Milburn & Peterson, P.C.; Robert C. Peterson

(57) ABSTRACT

An incarceration facility includes a control center with a panoramic view of cell units, recreation area, work area, entryway, multi-purpose rooms and stairwells. From the control center the entire facility is under 100% surveillance in which the complete interior of the cell units, stairwells, recreation area, work area, entryway and multi-purpose rooms are fully visible. All structures facing the control center are of transparent material and, excluding the exterior walls surrounding the facility, all solid walls are radially aligned to the control center. The radial omni-view facility provides the usual inmate activities of living, eating, recreation, work, study and congregation in a facility having absolutely no blind spots and constant surveilability of the inmates.

15 Claims, 8 Drawing Sheets

INCARCERATION FACILITY

BACKGROUND OF THE INVENTION

The present invention generally relates to incarceration facilities and in particularly to such a facility which deters or is resistant to prisoners escape, suicide, fire, predator and prohibited acts. The facility is designed in a radial pattern with a facility center point control center, pod or tower. The design being referred to as a radial omni-view.

BRIEF DESCRIPTION OF PRIOR ART

Incarceration facilities are used to detain persons who have been accused of or convicted of crimes in a relative degree of security for the type of crimes committed thus the facilities can be of medium or maximum security. Maximum security incarceration facilities typically receive criminals of high risk because of their potential escape and danger to society. Current facilities design consistently requires relatively high ratios of guards to inmates. Construction of such maximum security facilities relatively escape resistant does not appear possible utilizing current designs.

Contemporary rectilinear designs require numerous staff intensive Duty Stations (a Duty Station is where at least one staff is continuously on duty, seven days, twenty-four hours per day and three-hundred-sixty-five days per year). It is accepted practice to assign five point one (5.1) staff per duty station to properly surveil all inmates.

Contemporary rectilinear design requires up to eight 24 hour duty stations while the present invention, radial omni-view design only requires one and includes perimeter security as well. The importance of the present invention can best be appreciated by considering approximately eighty percent of total cost of contemporary rectilinear correctional facilities over thirty years is for staff.

Continuous increases in prison population and court ordered reduction in prison overcrowding has exacerbated the dilemma of adequate incarceration facilities.

The increase in the number and capacity of incarceration facilities portend extensive facilities and staff greatly increasing the cost associated with incarceration of persons under the criminal justice system. From the late 1800's numerous incarceration facility designs have been promoted for example, circular type jail construction.

Previous circular type jail construction has afforded a limited degree of reduction in the staff or increase efficiency of staff to properly supervise and surveil inmates, to decrease blind spots in the jail cells and to limit the time the inmates are not under surveillance because of the cell design arrangement.

U.S. Pat. No. 244,358 issued to Brown, et al describes a high security rotating cell arrangement in which the cells are closed at all times except when opposite a general entry door. Further, no escape can be effected except by cutting through the stationary solid grating surrounding the cells which are necessarily being moved from one position to another which lessens that opportunity. A corridor surrounds the exterior of the circular cells with the heavy grating. Unfortunately, this arrangement does not afford constant surveillance of the inmates from a central point.

U.S. Pat. No. 516,450 issued to Salfield, et al describes a semicircular jail construction with a central control room with the cells arranged radially around a corridor between the cells and the central control room. Between cells are aisles which are under surveillance from the central control room and entry to the cells are diametrically opposed along the aisle, such that the inmates in a cell can not view the inmates of the adjacent cell across the aisle. Unfortunately, this arrangement does not allow the guard in the central control room to view the inmates in their cells.

U.S. Pat. No. 729,913 issued to Angell discloses a circular design building construction for a group of stores or apartments for other purposes which guard against fire or burglary at minimum expense. Central to the building which houses the utilities including a cistern, cellar for storing fuel, a machinery room, a room for a guard or a watchman and a water tank at the upper most level. The building construction discloses no particular arrangement of the interiors of the stores or apartments. Such a construction would be unsuitable to serve as an incarceration facility for criminals.

SUMMARY OF THE INVENTION

An incarceration facility in accordance with the present invention comprises a circular arrangement of cells, work and exercise yard, classrooms, security hall access, a sub-level outdoor courtyard work area which may be observed from the omni-view control center providing a radial view of the incarceration facility.

An object of the radial omni-view cell arrangement includes a series of cells designed to house as few as one inmate (maximum security) or as many as thirty-two or more inmates (medium security) with all the interior load bearing walls in radial alignment to the control center observation post where all in cell activities are in full view and observable including personal hygiene facilities having translucent walls which provide a degree of modesty but permitting appropriate observation of the inmates when attending to personal hygiene matters, hence, the inmates are under constant surveillance. As appropriate, the arrangement provides individual inmates a personal space platform which contains a combination computer-high definition color television for educational use, personal valuables locker with suitable lock, a clothing locker, book shelves, appropriate bedding, lights, waste basket and a telephone jack.

In the central area of the cell are recessed washer/dryer units. Walls support a personal table and seat for each inmate. In this arrangement with the radial omni-view 100% surveillance system of all areas of the cell at all times provides a suicide, escape, fire, predator and prohibited acts resistant facility.

Another objective of the radial omni-view incarceration facility includes the provision of classrooms, outdoor recreational area and a sub-level outdoor courtyard work area which are maintained 100% under surveillance along with all the cells from the control center room. The radial omni-view control center is one way mirrored, includes a 360° field of view of the entire facility and may be provided with a closed circuit television recording, including time and date stamp backup, of every cell, every hour of every day.

Further object of the invention is to provide a maximum degree of surveillance of inmates in all phases of their daily activities with a minimum of security officers. Staff may be directed by radio or other appropriate means from the facility control center, thus prison officials, educational instructors, exercise yard supervisors and the prison work force staff can concern themselves with controlling the normal ongoing activities under their supervision.

DETAILED DESCRIPTION OF THE INVENTION

Figure 1:
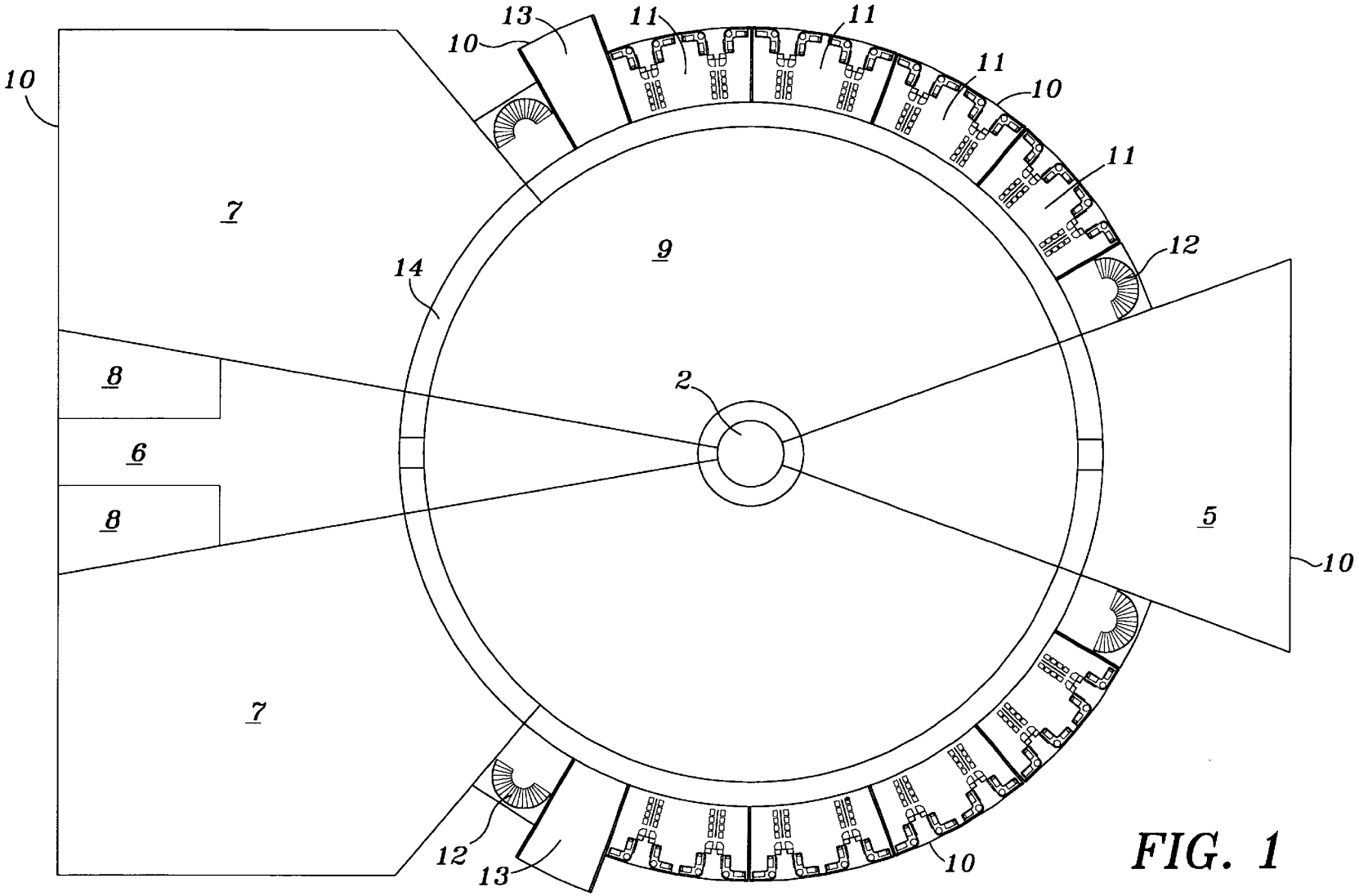
FIG. 1 is a top plan view of the overall incarceration facility.

Referring now to FIG. 1, the Omni-view Incarceration Facility generally referred to as 1 has a circular central control center 2 with a 360° field of view through mirrored windows 3. The arrangement permits observation through mirrored windows 3 of a secure outdoor recreational area 5; the security entry 6; multipurpose rooms 7; office 8; and sub-level outdoor courtyard work area 9. From the control center room 2, each of the cell units 11 may be observed as well as the semicircular stairwells 12. Semicircular stairwells 12 lead from corridor 14 down to work area 9. Also, classrooms 13 are provided between the stairwell 12 and cell units 11 which have see-through doors or openings where the entire classroom 13 can be observed from control center 2. It will be noted that the field of view from the control center 2 is 360° which provides observation throughout the entire facility without any blind spots. The outer exteriors 10 of the facility are of escape proof construction with outer access to utility area 41 and main security entry 6. Thus, this facility is resistant to suicide, escape, fire, predator and prohibited acts by the inmates or outside forces.

Figure 2:
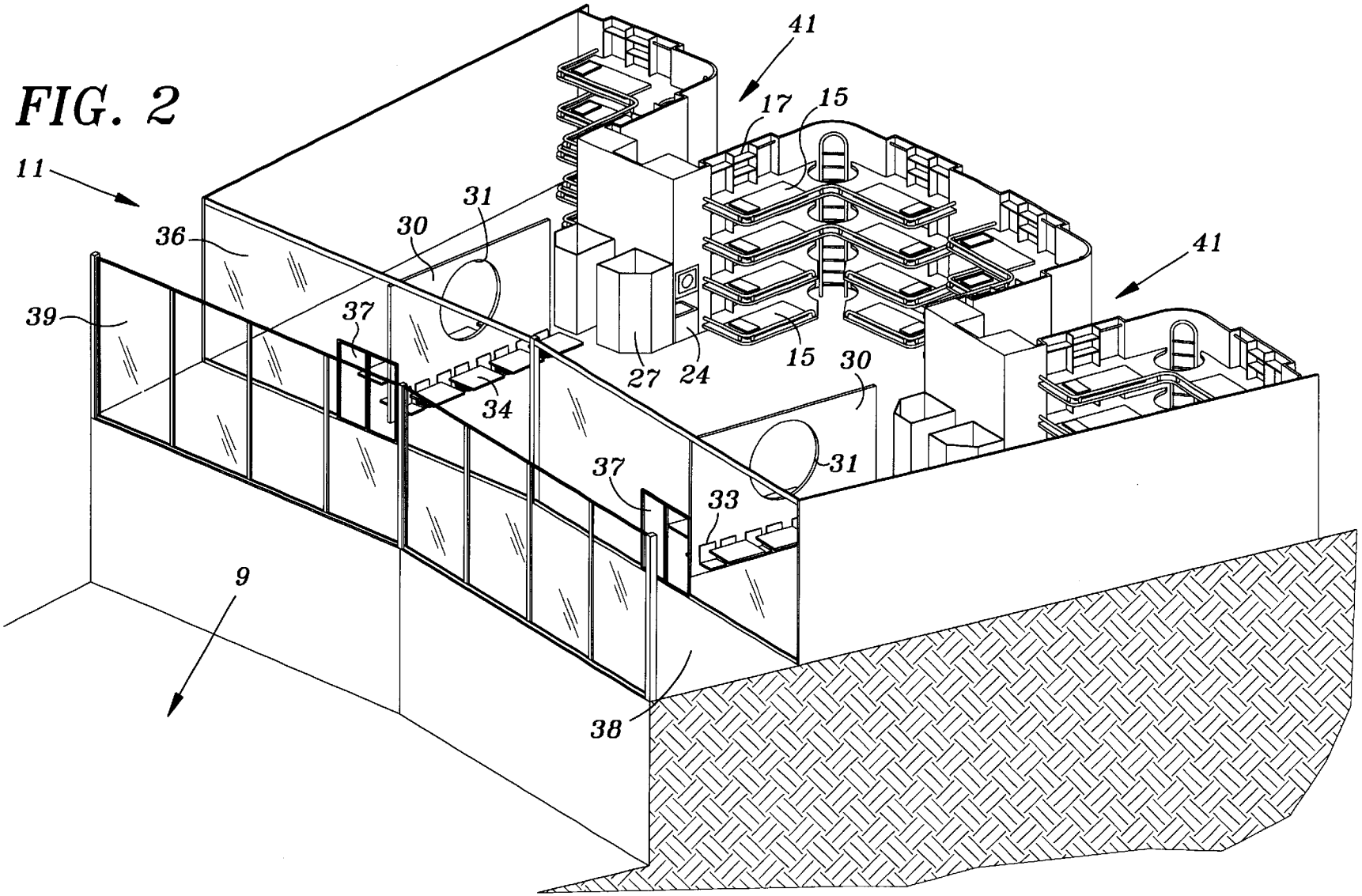
FIG. 2 is a perspective view of an individual 32 inmate cell unit arrangement.
Figure 2A:
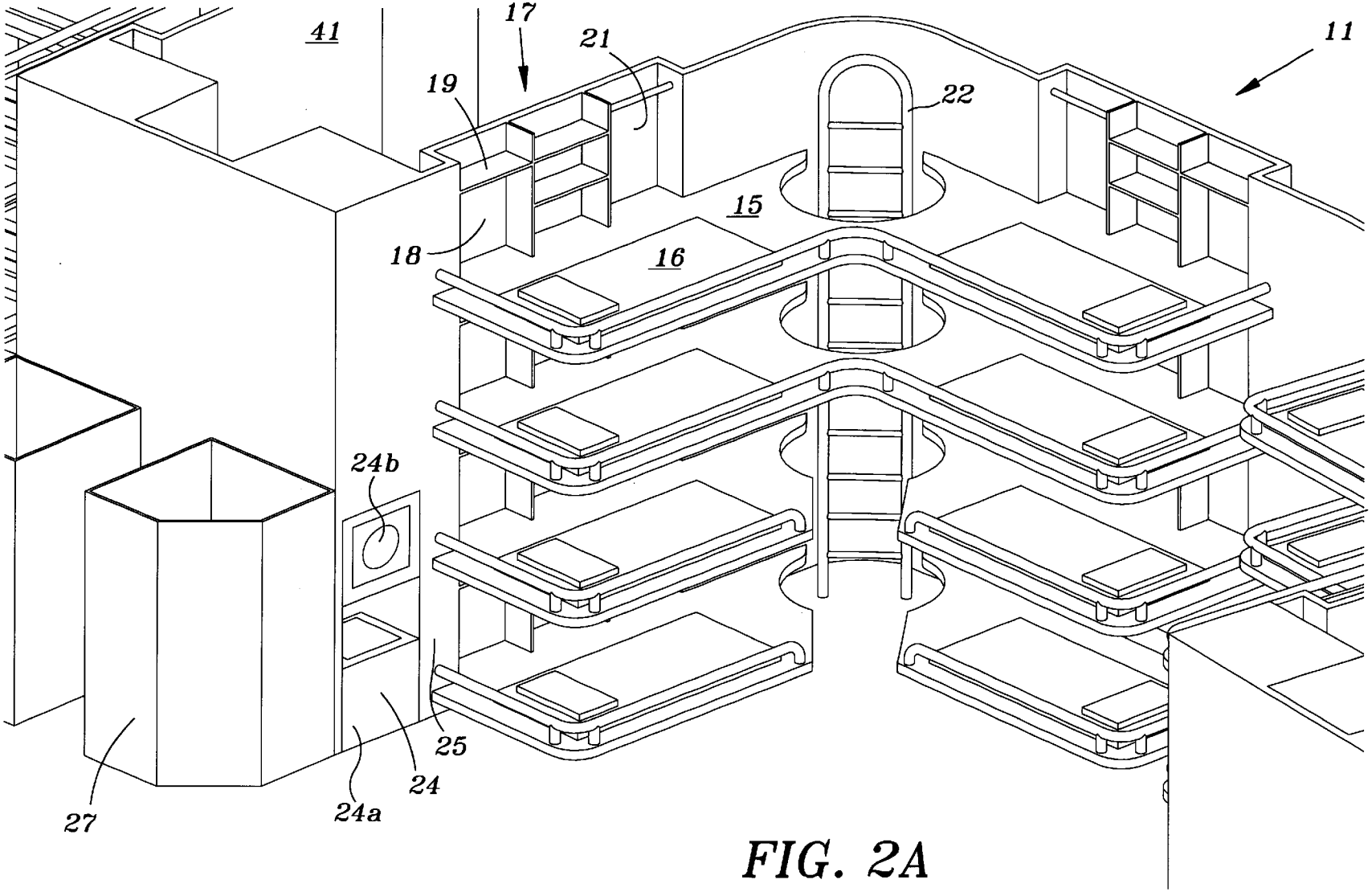
FIG. 2*a* is a partial perspective view of the personal platform, personal hygiene facility and recessed washer/dryer combination.
Figure 3:
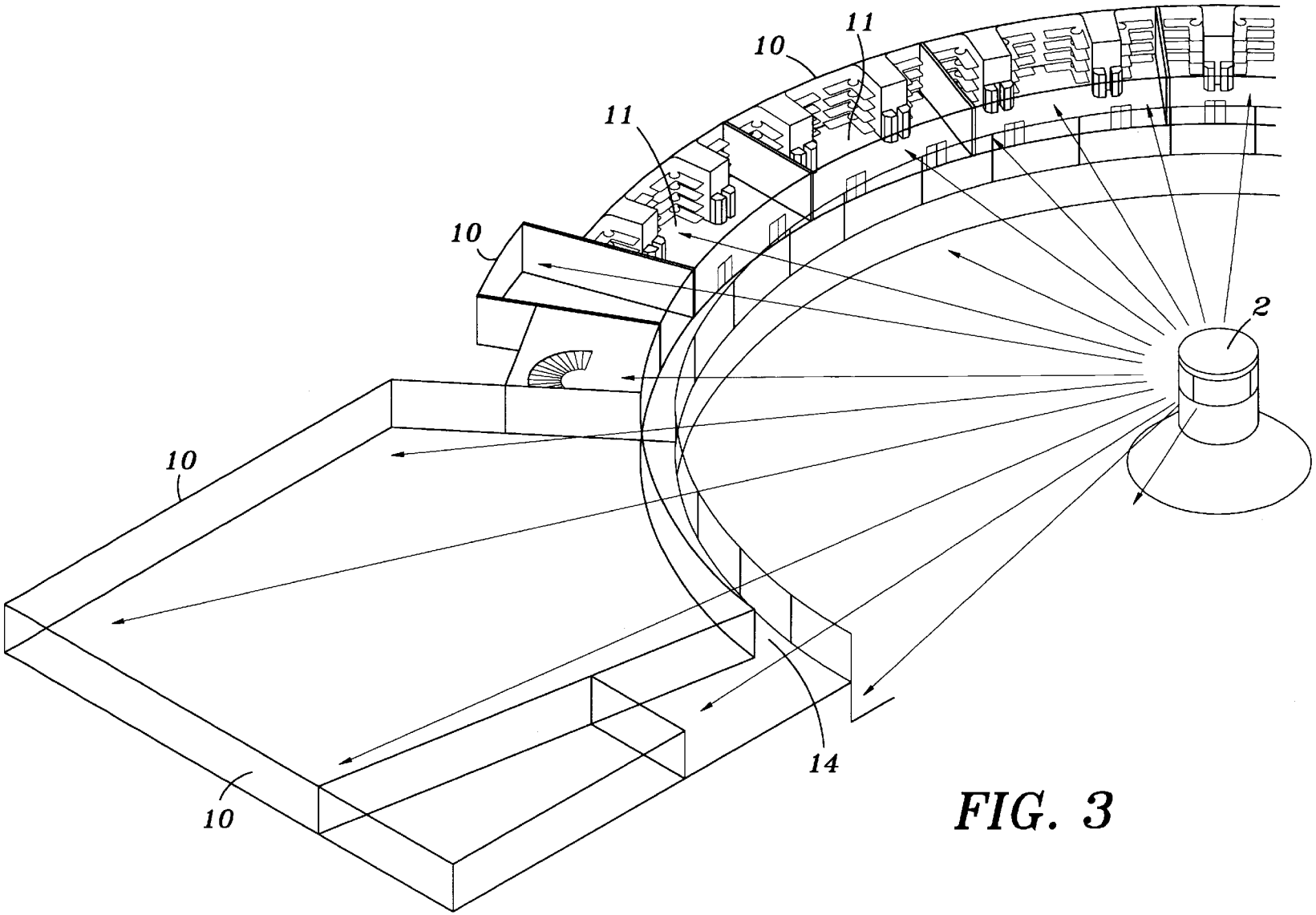
FIG. 3 is a partial perspective view of a portion of the omni-view incarceration facility illustrating the view into the cells, multiple use rooms, outdoor courtyard work area and stair well from the control center.

Referring to FIGS. 2, 2*a*, 3 and 4, a more detailed description of the cell units 11 is described. Each individual inmate is provided with a personal space platform 15. The personal space platform 15 as best seen in FIG. 2*a*, includes bedding 16, which includes mattress, pillow, blanket and sheets, a wall cabinet 17 with combined computer-television space 18, locker space 19, and clothing space 21. The personal space platform 15 are accessible from the floor at the lower levels and by way of ladder 22 which extends from the floor to the top of cell unit 11. Each cell unit 11 has four stacked washer/dryer units 24 which are recessed in wall 25. Thus, the inmates can be required to wash and dry their clothing in the cell unit 11. The distance between washer unit 24*a* and dryer unit 24*b* is insufficient for an inmate to hide from view of the control center 2. Each cell unit 11 has four personal care enclosures 27 which includes a combination shower, wash basin, toilet and dressing area which are constructed to provide a degree of privacy yet permit observation of an individuals figure while inside the personal care enclosure 27. Each cell unit 11 includes two partitions 30 which are aligned along a radii of the line of sight of the control room 2. Each partition 30 has a circular cut out 31 which permits the inmates an open view through out the cell area. Each partition 30 has sixteen cantilevered seats 33 and eight cantilevered double tables 34. Each double table 34 provides eating space and work space for two inmates. Thus, instead of the inmates going to a central dining hall, which would require relatively large gatherings of inmates, inmates are served their meals in their respective cell units 11. The front walls 36 of cell units 11 are made of strong clear plastic or glass to facilitate viewing the entire interior of cell units 11 from control center 2 leaving no blind spots where an inmate might hide from view. Each cell has two double doors 37 which are likewise clear plastic or glass. A corridor 14 provides a walkway around the entire inner periphery of the incarceration facility 1. Since the entire secure work area 9 is below the level of corridor 14, clear plastic or glass barriers 39 are provided around the edge of corridor 14 opposite from cell units 11.

Figure 4:
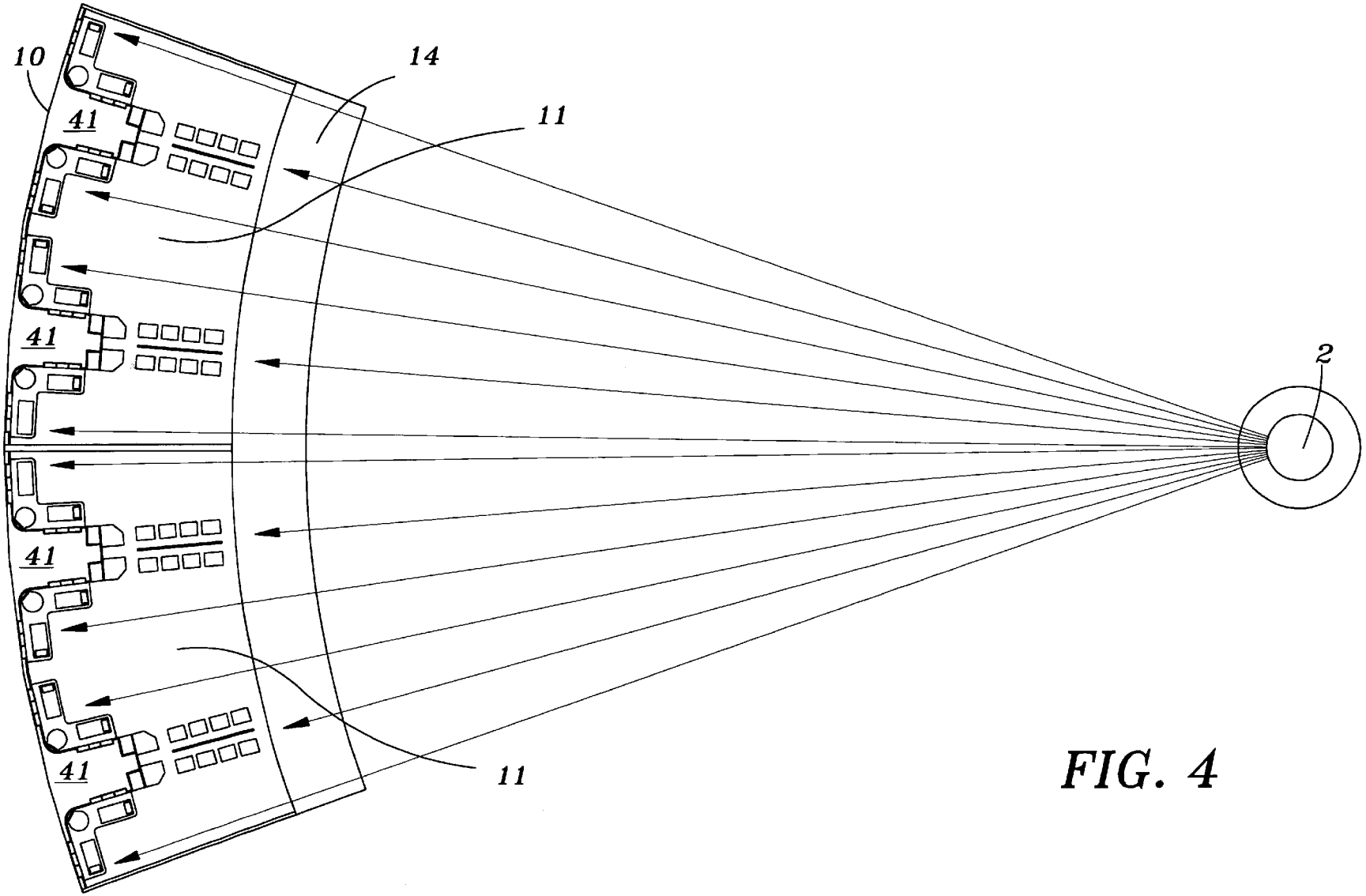
FIG. 4 is a top plan view with the roof removed illustrating the arrangement of the personal space platform, recessed washer/dryer facilities, rear entry utility area and the personal hygiene facilities of two cell units radially aligned with the facility control center.

Referring further to FIG. 4, each cell unit 11 has two utility access spaces 41 behind personal care enclosure 27 and four stackable washer/dryer combination 24 and personal space platform 15, thus permitting access to the utility area 41 through outer extremities 10 without entry into the cell unit 11.

Each cell unit 11 designed for 32 inmates is a sector of a circle approximately ninety feet wide at the widest dimension and seventy feet wide at the narrowest dimension. The depth of cell unit 11 is approximately sixty feet. The corridor in front of the cell unit is approximately fifteen feet wide and its narrowest length is approximately sixty-six feet. Between the control center 2 and cell unit 11 is approximately one hundred feet. It should be noted that control center 2 provides a horizontal view into each cell unit 11, thus the angle of sight into cell units 11 is free of any blind spots. It should be understood that these dimensions vary with the particular diameter of the overall incarceration facility.

Stairwell 12 is designed for access to the outdoor courtyard work area 9 such that from the control center 2 individuals ascending and descending the staircase 12 can be observed.

Figure 5:
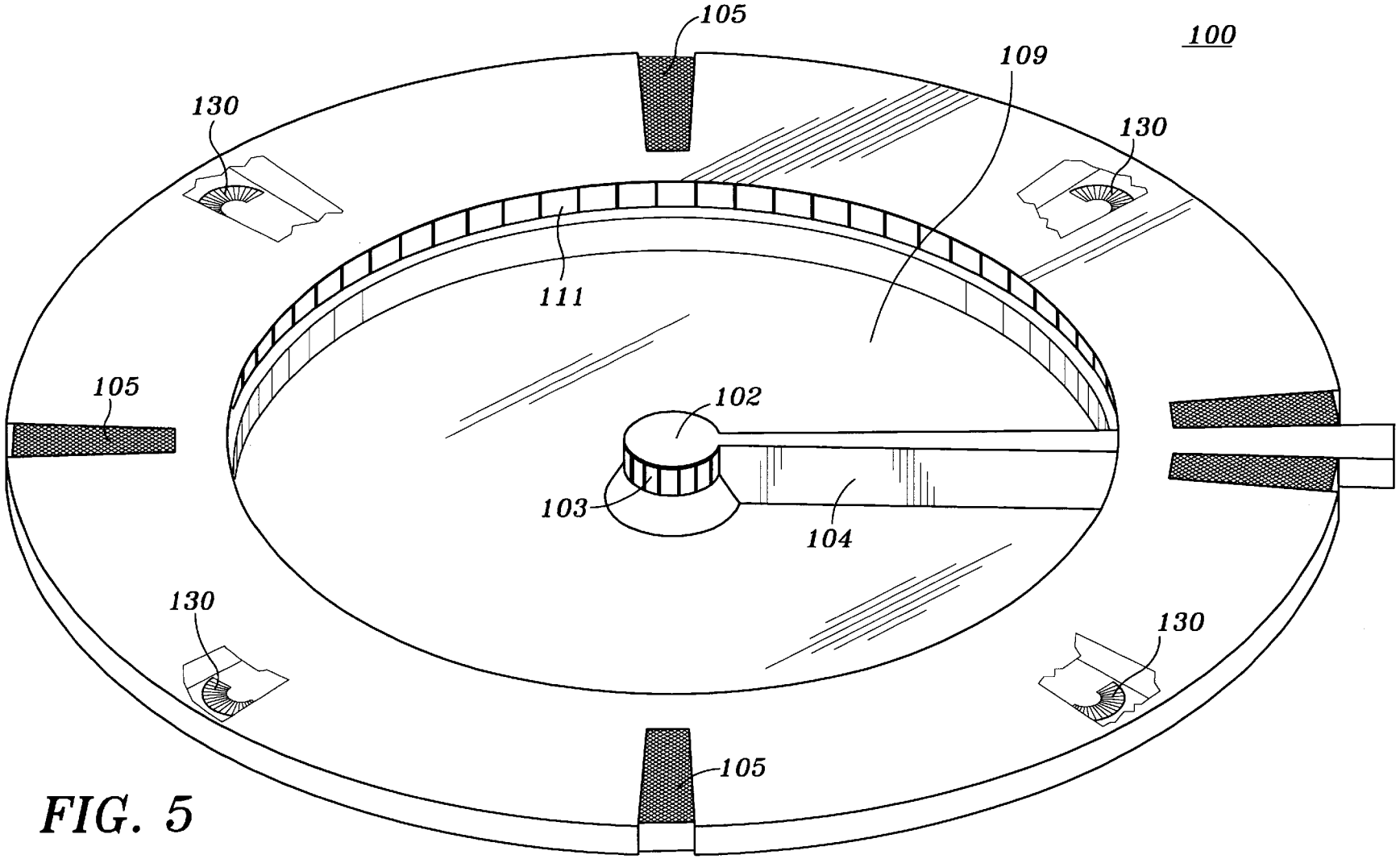
FIG. 5 is an overall perspective view of a high security omni-view incarceration facility.
Figure 6:
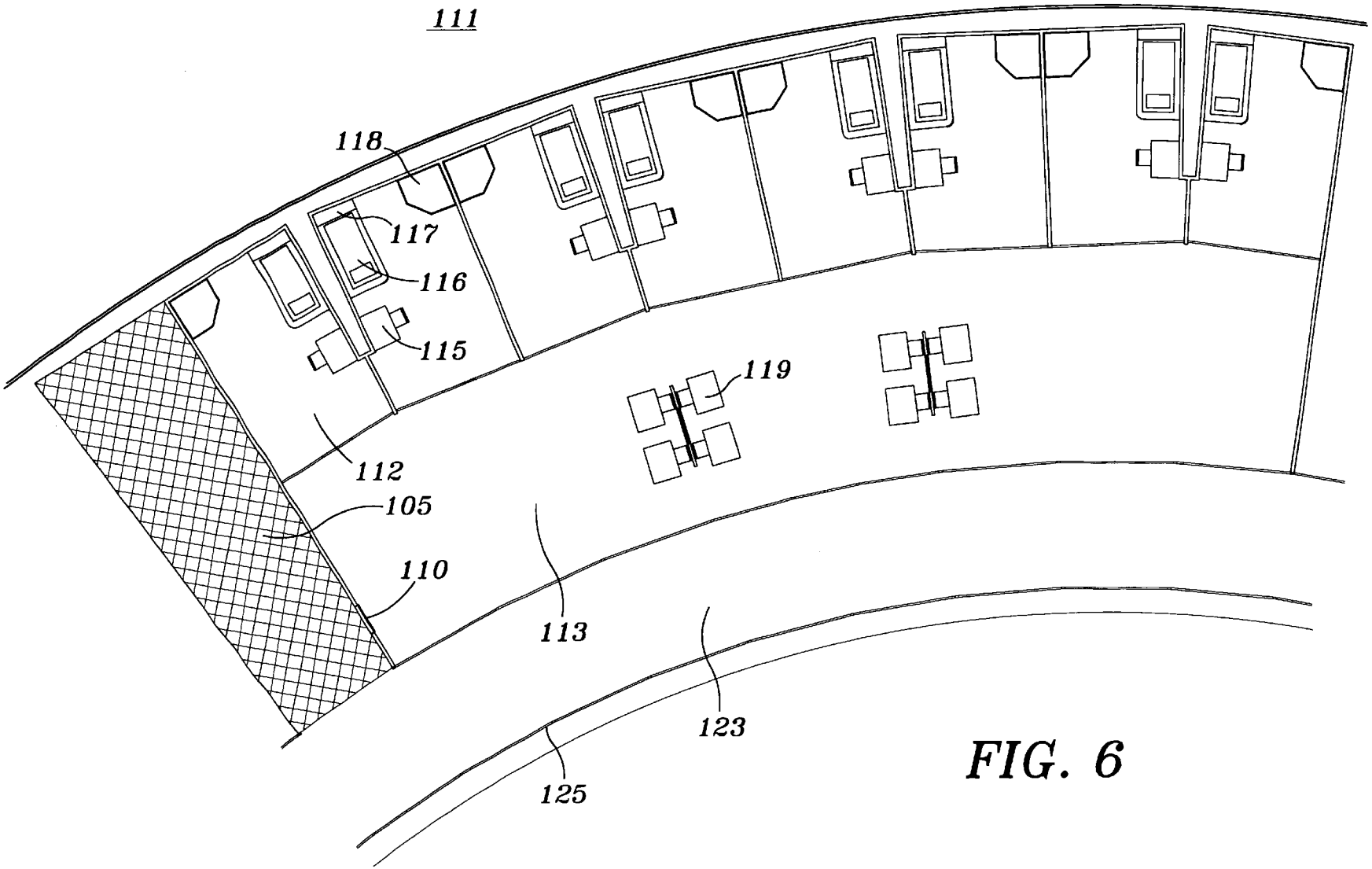
FIG. 6 is a partial top plan view of the interior of a security cell unit and the outdoor recreational area.
Figure 7:
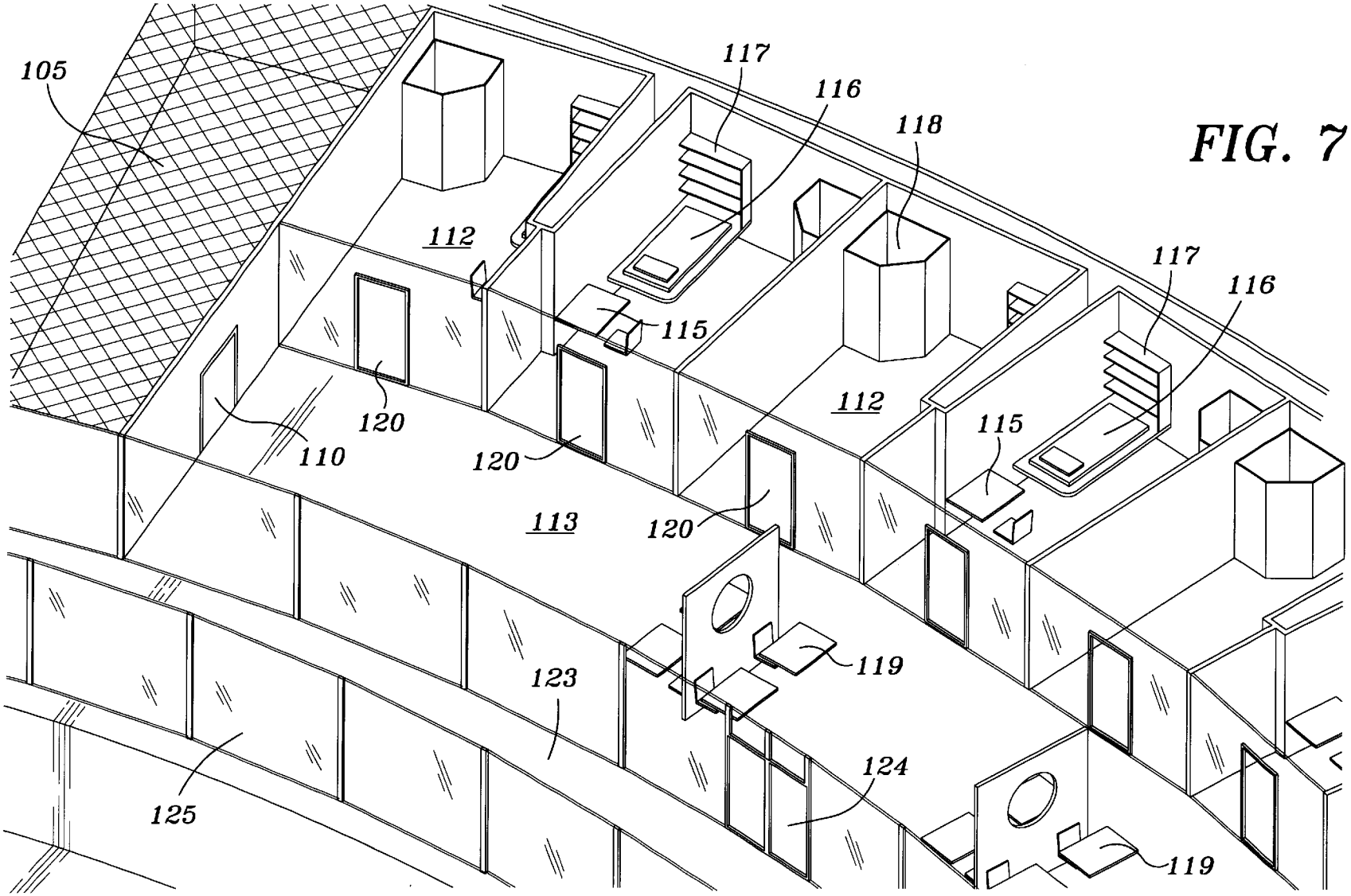
FIG. 7 is a partial perspective view of the security cells, day room and recreational area.

Referring now to FIGS. 5, 6 and 7, a high security omni-view incarceration facility 100 is illustrated. Omni-view facility 100 has a control center 102 with a field of view including the entire omni-view facility 100, as well as secure entryway 104 through mirrored windows 103. The arrangement provides observation through mirrored windows 103 of the sub-level outdoor courtyard area 109, the cell units 111 and outdoor recreational area 105. Secure entryway 104 houses offices 8 as shown in FIG. 1 of the prison which is observable from the control center room 102.

Referring particularly to FIGS. 6 and 7, each cell unit 111 has eight single cells 112 that each house a single inmate and open into day room 113 which accommodates the eight inmates. Each cell 112 has a cantilevered table and chair 115, a bed 116, shelving 117 for placement of clothing and other articles permitted the inmates, and personal care enclosure 118 which houses a commode, washbasin, shower and dressing area. The dayroom 113 has eight cantilevered tables and chairs 119 which permit all of the inmates to be seated in the day room 113 at the same time whenever desired. Some inmates may not be permitted to leave their cells 112 except for mandatory exercise access in outdoor recreational area 105. The doors 120 to each cell 112 may include a pass through (not shown) to feed the inmates in the cells 112 in certain circumstances where the inmate is extremely incorrigible or over all security demands that all the inmates be confined to cells 112.

A corridor 123 encircles entire cell units 111, stairwell 130, and recreational area 105. Day room 113 has a double door 124 to corridor 123. The outdoor recreational area 105 has a wire mesh roof 110 to provide outdoor air and light. Surrounding corridor 123 is clear plastic or glass barrier 125.

It should be noted that the control center 2 or 102 has a horizontal view into each cell unit 11 or 111, as well as, all other areas on the same level which avoid any blind areas. The sub-level courtyard area with the slope of control center base is observable without any blind areas.

What is claimed is:

1. An omni-view incarceration facility for housing inmates in a secure environment with total visual surveillance, comprising:

(a) a control center having a panoramic field of view;

(b) a series of cell units fully viewable from the control center, positioned along an inner periphery radially spaced from the control center, each cell unit in cell sectors of the control center field of view;

(c) a secure entryway in an entry sector of the control center field of view;

(d) an outdoor recreational yard in a yard sector of the control center field of view;

(e) a stairway within a stairwell sector along the inner periphery in the control center field of view;

(f) an activities room within a room sector along the inner periphery in the control center field of view;

(g) a corridor encircling the inner periphery traversing the various sectors including the cell sectors, the field sector and the entry sector;

(h) an outdoor work area forming a circular region at a level below the corridor in the field of view being accessible from the stairway;

(i) a first arcuate wall spanning the field sector of the recreational yard, along the inner periphery, with a first central sally port for ingress and egress;

(j) a second arcuate wall spanning the entry sector of the secure entryway along the inner periphery with a second central sally port for ingress and egress from the incarceration facility; and (k) a barrier encircling the corridor above and adjacent the work area.

2. The omni-view incarceration facility of claim 1 wherein each cell unit includes:

(a) an individual personal space platform for each of up to thirty-two inmates; and (b) an individual stationary table and seat for each of up to thirty-two inmates.

3. The omni-view incarceration facility of claim 2 wherein each cell unit includes at least a personal care enclosure containing a lavatory, commode, shower and dressing space.

4. The omni-view incarceration facility of claim 2 wherein each individual personal space platform is provided with a bed and a wall cabinet.

5. The omni-view incarceration facility of claim 4 wherein the wall cabinet includes a locker space and clothing space.

6. The omni-view incarceration facility of claim 5 wherein the wall cabinet includes a computer-television combination space.

7. The onmi-view incarceration facility of claim 5 wherein each cell unit is provided with clothes washer and dryer facilities.

8. A omni-view incarceration facility for housing inmates in a secure environment with total visual surveillance, comprising:

(a) a control center having an unobstructed complete field of view of the facility;

(b) a series of fully viewable cell units from the controlled center, positioned along a perimeter radially distant from the control center, in cell sectors of the control center's field of view;

(c) a secure entryway for ingress and egress of the facility in a fully visible entry sector of the control center field of view;

(d) an outdoor recreational yard in a fully visible yard sector of the control center field of view;

(e) a corridor surrounding the perimeter traversing the various sectors including the cell sectors, the yard sector and the entry sector for ingress and egress within the facility.

9. The omni-view incarceration facility of claim 8 wherein each cell unit includes single inmate cells including a bed, a stationary table and seat, and a personal care enclosure, each cell connecting to a day room that accommodates up to eight inmates, the day room providing access to the outdoor recreational yard and the corridor.

10. A omni-view incarceration facility for housing inmates in a secure environment with total visual surveillance, comprising:

(a) a control center having a circular field of view;

(b) a secure entryway in an entry sector of the control center field of view;

(c) an outdoor recreational yard in a yard sector of the control center field of view;

(d) a series of surveilable cell units from the controlled center, positioned along an inner periphery spaced from the control center, in cell sectors of the control center's field of view;

(e) each cell unit having lockable access to a day room, and having an entryway between the outdoor recreational field and the day room; and (f) a corridor encircling the inner periphery traversing the various sectors including the cell sectors, the yard sector and the entry sector for appropriate access to the facility.

11. The omni-view incarceration facility of claim 10 which includes a stairway within a stairwell sector in the control center field of view; an outdoor work area at a level below the corridor in the field of view, being accessible from the stairway; and an arcuate wall spanning the entry sector of the secure entryway, said wall having a central sally port for ingress and egress from the incarceration facility.

12. The omni-view incarceration facility of claim 10 wherein the entryway is an enclosed passageway providing access between the control center and the corridor.

13. The omni-view incarceration facility of claim 10 wherein walls between the cell units, secured entryway, and recreational field are aligned along radii from the control center.

14. The omni-view incarceration facility of claim 10 wherein the control center is equipped with audio-visual recording media.

15. The omni-view incarceration facility of claim 8, wherein each viewable cell unit has a pair of side walls with each side wall oriented on different radii of the control center field of view, a rear wall joining the side walls along an outer periphery distant from the control center and a transparent front wall nearer the control center joining the side walls along an inner periphery.

* * * * *